US006515416B1

(12) United States Patent
Chico

(10) Patent No.: US 6,515,416 B1
(45) Date of Patent: Feb. 4, 2003

(54) METHOD FOR MANUFACTURING ELECTROLUMINESCENT LAMPS AND APPARATUS PRODUCED THEREBY

(75) Inventor: Arniel A. Chico, Lapu-lapu (PH)

(73) Assignee: Timex Group B.V., Middlebury, CT (US)

( * ) Notice: Subject to any disclaimer, the term of this patent is extended or adjusted under 35 U.S.C. 154(b) by 0 days.

(21) Appl. No.: 09/560,485

(22) Filed: Apr. 28, 2000

(51) Int. Cl.[7] ..... H05B 33/10; G04B 19/30

(52) U.S. Cl. ..... 313/506; 313/510; 445/24; 368/67

(58) Field of Search ..... 313/504, 506, 313/510, 512, 513; 445/24; 368/223, 224, 225, 226, 227

(56) References Cited

U.S. PATENT DOCUMENTS 4,114,983 A 9/1978 Maffitt et al. ..... 350/164
5,224,078 A 6/1993 Mallin ..... 368/223
5,552,679 A 9/1996 Murasko ..... 315/169.3
5,620,348 A 4/1997 Santana et al. ..... 445/24
5,734,627 A * 3/1998 Sy ..... 313/510
5,820,957 A 10/1998 Schroeder et al. ..... 428/40.1
5,964,514 A 10/1999 Carter et al. ..... 362/23
5,971,556 A 10/1999 Carter et al. ..... 362/23
6,208,591 B1 * 3/2001 Sakurazawa et al. ..... 313/510

* cited by examiner

*Primary Examiner*—Vip Patel
*Assistant Examiner*—Joseph Williams
(74) *Attorney, Agent, or Firm*—Carmody & Torrance LLP

(57) ABSTRACT

An electroluminescent (EL) lamp for an electronic device includes a transparent substrate having a first and a second surface, a translucent layer formed on the first surface and a transparent electrically conductive layer formed on the second surface of the transparent substrate. The translucent layer includes a surface having a selected surface configuration. The EL lamp further includes an EL layer formed on the transparent conductive layer, an insulating layer formed on the EL layer, and an electrically conductive layer formed on the insulating layer. In one embodiment, the selected surface configuration of the translucent layer includes a metallic finish. In another embodiment, the selected surface configuration includes either a coarse or a smooth textured finish. A method of manufacturing the EL lamp is also disclosed.

15 Claims, 3 Drawing Sheets

(1 of 3 Drawing Sheet(s) Filed in Color)

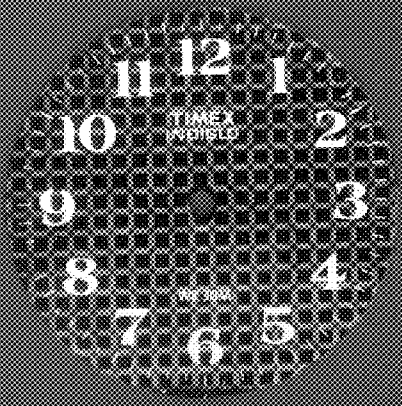
3A
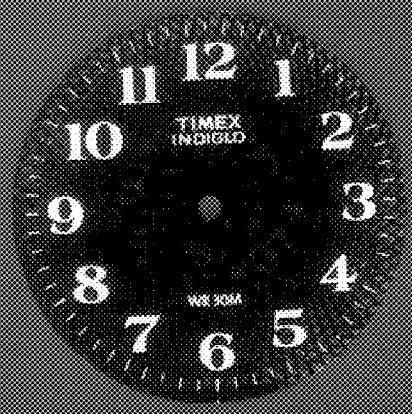
3B
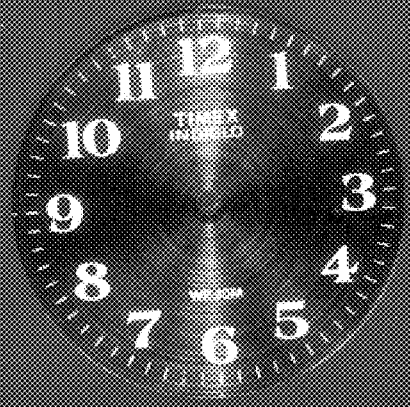
3C

METHOD FOR MANUFACTURING ELECTROLUMINESCENT LAMPS AND APPARATUS PRODUCED THEREBY

FIELD OF THE INVENTION

The present invention relates generally to a method for manufacturing electroluminescent lamps for electronic devices and, more particularly, to an improved method for manufacturing and construction of electroluminescent lamps for an electronic device such as an electronic timepiece.

BACKGROUND OF THE INVENTION

It is well known in the art that electroluminescent ("EL") lamps are generally included within the construction of dials and displays for electronic devices. The EL lamps permit an illumination of the dials and displays so that information exhibited thereon may be more readily viewed in an environment of low ambient light. EL lamps are generally constructed as layered structures. For example, U.S. Pat. No. 5,620,348, issued on Apr. 15, 1997, to Santana et al. describes an EL lamp comprising a transparent substrate, a front electrode, an EL layer, an insulating layer and a back electrode. The disclosure of U.S. Pat. No. 5,620,348, is incorporated by reference as if fully set forth herein.

Generally speaking, the substrate and the front electrode of the EL lamp are transparent to permit light emitted by an energized EL layer to pass through these layers to illuminate the dial or display configured on a face of the EL lamp. As is known, the EL layer is energized by application of an electrical potential between the front and back electrodes.

A perceived deficiency in these prior art EL lamps is the limitations in surface configurations for the face of the dials and displays. That is, the visual appearance of surface configurations and finishes of dials and displays incorporating conventional EL lamps generally are secondary to the need for transparency during illumination operations. In particular, conventional surface configurations for dials and displays do not provide for metallic finishes and/or coarse or smooth textured surfaces.

Therefore, the present invention provides a method for manufacturing and a construction of EL lamps that permits visually appealing surface configurations without sacrificing the transmission of light from energized EL layers to illuminate the dial and/or display.

OBJECTS AND ADVANTAGES OF THE INVENTION

Therefore, it is a first object and advantage of this invention to provide a method for manufacturing EL lamps having visually appealing surface configurations.

It is another object and advantage of this invention to provide a method for manufacturing and construction of EL lamps having a face with a surface configuration having a metallic and/or textured finish.

It is yet another object and advantage of the present invention to provide a material on the surface of the dial that can reflect incident ambient light and yet transmit light received from the EL layer when the EL layer is energized.

Further objects and advantages of this invention will become more apparent from a consideration of the drawings and ensuing description.

SUMMARY OF THE INVENTION

The foregoing and other problems are overcome and the objects and advantages are realized by an apparatus constructed in accordance with embodiments of this invention, wherein an improved method for manufacturing and construction of an EL lamp having a face with a surface configuration of a metallic and/or textured finish is disclosed.

Generally speaking, the present invention comprises an EL lamp for an electronic device that includes a transparent substrate having a first and a second surface, a translucent layer formed on the first surface and a transparent electrically conductive layer formed on the second surface of the transparent substrate. The EL lamp further includes an EL layer formed on the transparent conductive layer, an insulating layer formed on the EL layer, and an electrically conductive layer formed on the insulating layer. The translucent layer, the transparent substrate, the transparent electrically conductive layer, the EL layer, the insulating layer and the electrically conductive layer together comprise a layered assembly. In accordance with the present invention, the translucent layer includes a surface having a selected surface configuration.

In one embodiment, the selected surface configuration of the translucent layer includes a metallic finish. In another embodiment, the selected surface configuration includes either a coarse or a smooth, textured finish.

A method of manufacturing the EL lamp is also disclosed. The EL lamp is a layered assembly, which includes a transparent substrate having a first surface and a second surface, an EL layer and a transparent electrically conductive layer interposed between the EL layer and the second surface of the transparent substrate. The EL lamp further includes an insulating layer and an electrically conductive layer. In accordance with the present invention, the method further includes steps of providing a translucent layer having a first surface and a second surface, affixing the second surface of the translucent layer to the first surface of the transparent substrate and forming a surface configuration on the first surface of the translucent layer. In one embodiment, the step of forming includes forming either a coarse or a smooth textured finish on the first surface of the translucent layer.

BRIEF DESCRIPTION OF THE DRAWINGS

The file of this patent contains at least one drawing executed as a color photograph. Copies of this patent with color drawing(s) will be provided by the Patent and Trademark Office upon request and payment of the necessary fee.

The above set forth and other features of the invention are made more apparent in the ensuing Detailed Description of the Preferred Embodiments when read in conjunction with the attached Drawings, wherein:

FIGS. 3A–3C is a photograph illustrating exemplary surface configurations of the EL lamp of FIG. 2.

Identically labeled elements appearing in different ones of the above-described figures refer to the same elements but may not be referenced in the description for all figures.

DETAILED DESCRIPTION OF THE PREFERRED EMBODIMENTS

Figure 1:
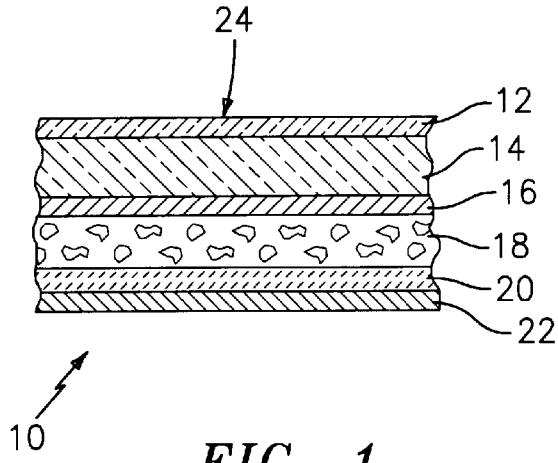
FIG. 1 is an enlarged, partial side elevational view in cross section of an EL lamp constructed in accordance with the present invention.

FIG. 1 illustrates an electroluminescent ("EL") lamp, shown generally at 10, constructed in accordance with the present invention. As is shown, the EL lamp 10 is constructed as a layered structure. It should be appreciated that FIG. 1 is not drawn to scale and that the layers of the EL lamp 10 have been enlarged to ease illustration and understanding thereof.

The EL lamp 10 includes a translucent layer 12 formed on a top surface of a transparent substrate 14, and a transparent electrically conductive layer 16 formed on a surface of the transparent substrate 14 opposite to that of the translucent layer 12. The EL lamp 10 further includes an EL layer 18 formed on a bottom surface of the transparent conductive layer 16, an insulating layer 20 formed on the EL layer 18, and an electrically conductive layer 22 formed on the insulating layer 20.

As is generally known, the transparent electrically conductive layer 16 is also referred to as a front electrode, and the electrically conductive layer 22 is also referred to as a back electrode. In operation, the EL layer 18 emits light when energized by application of an electrical potential between the front and the back electrodes, layers 16 and 22 respectively. Light emitted from the EL layer 18 is transmitted through the front electrode 16, the transparent substrate 14 and the translucent layer 12 to a top surface, generally indicated at 24, of the translucent layer which acts a face of the EL lamp 10. Further details of the manufacturing process can be found in the aforementioned U.S. Pat. No. 5,620,348.

In accordance with the present invention, the translucent layer 12 is comprised of a film that is applied to coat the top surface of the transparent substrate 14. For example, the translucent layer 12 may be a film or tint material similar to material applied to a glass substrate used in vehicle and/or building windows for controlling the transmittance of light. In accordance with the present invention, the top surface 24 of the translucent layer 12 is configured to provide a visually appealing finish not achievable with conventional EL lamp constructs. For example, and in accordance with one aspect of the present invention, the surface configuration of the top surface 24 is comprised of a metallic finish. In another aspect of the present invention, the surface configuration of the top surface 24 is comprised of a coarse or smooth textured finish. Exemplary surface configurations for achieving desired aesthetic finishes are discussed in further detail below.

Figure 2:
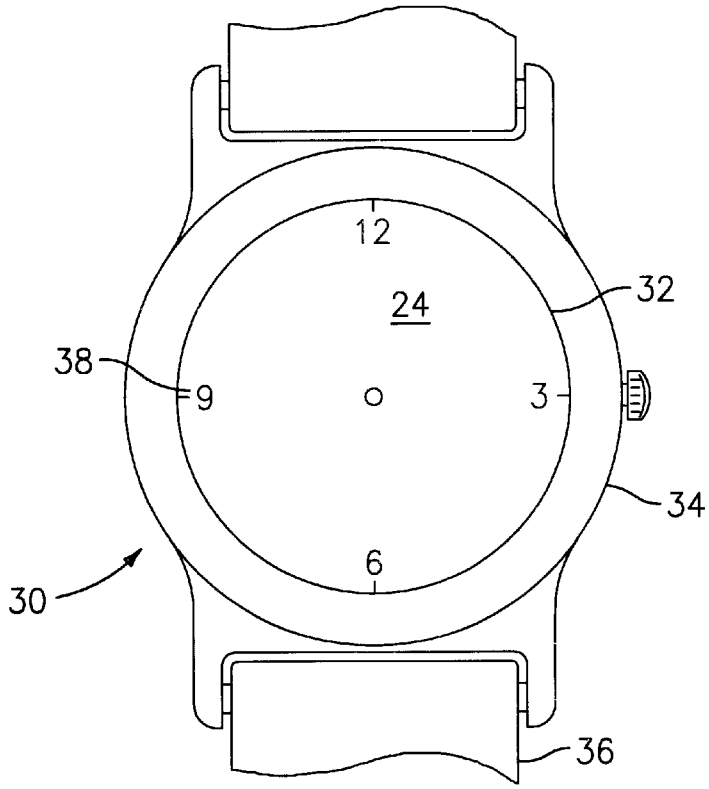
FIG. 2 is a simplified plan view of an electronic device having an EL lamp of a selected surface configuration serving as a dial thereof.

FIG. 2 illustrates an electronic device such as a timepiece 30 having a dial 32 that incorporates the EL lamp 10. The timepiece 30 includes a case 34 and a strap 36 for securing the timepiece 30 to a wrist of a wearer. The timepiece 30 also contains timekeeping circuitry (not shown) for performing timekeeping functions of the timepiece 30. In a timekeeping embodiment, the top surface 24 (i.e. the translucent layer 12) may include surface configurations in the form of time-indicating indicia 38 for indicating a time-of-day. In the timekeeping embodiment, the indicia 38 may be printed or otherwise affixed to the top surface 24.

FIGS. 3A–3C illustrate exemplary surface configurations for the top surface 24 of the dial 32 of FIG. 2. That is, various surface configurations are formed in the top surface 24 of the translucent layer 12 by, for example, hot stamping or brushing the surface 24 with an appropriate mechanical apparatus. In FIGS. 3A and 3B, coarse textured patterns are formed on the top surface 24 by, for example, hot-stamping the translucent layer 12 of the EL lamp 10. Preferably, the hot stamping operation is performed by applying a punch, heated to about 130° C., under about 90 PSI pressure to the translucent layer 12 for about 3 seconds ram down delay. Alternatively, a smooth pattern and/or a pattern of concentric circles may be formed on the top surface 24 by, for example, brushing the EL lamp 10. Preferably, the brushing operation is performed by applying a brush turning at a spindle speed of about 1500 RPM, under about 90 PSI pressure to the translucent layer 12 for about a 2 second ram down delay. Such a process can be both a wet or dry brushing as would be understood in the art.

Furthermore, an electronic device having a dial that incorporates the EL lamp 10 of the present invention may include surface configurations having both metallic and textured finishes that substantially transmits the light emitted from the EL layer 18 to illuminate the dial. In yet another alternative construction, a dial may be comprised of two layers, a first layer having a non-metallic, non-textured surface configuration and a centrally located opening therethrough, while the second layer has a metallic, textured surface configuration. The first layer may be is affixed onto the second layer such that the surface configuration of the second layer remains visible through the opening of the first layer.

Figure 4:
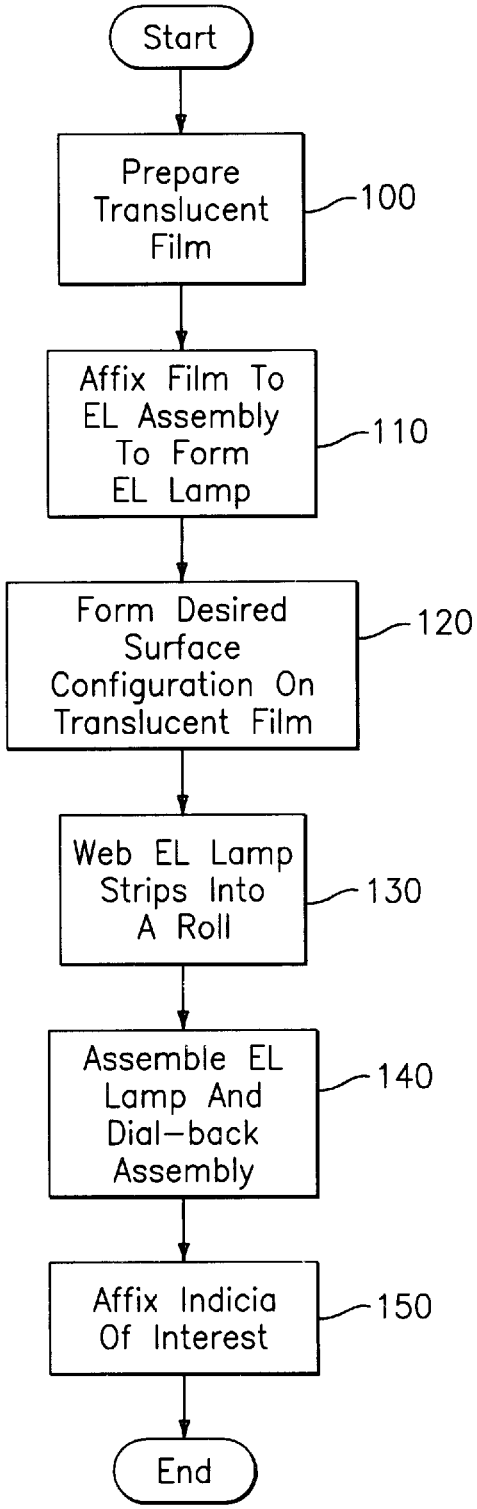
FIG. 4 illustrates a flow diagram of one embodiment of a methodology for manufacturing an EL lamp in accordance with the present invention.

FIG. 4 illustrates a preferred method for manufacturing an EL lamp in accordance with the present invention. At Block 100 a translucent film is prepared for assembly to an EL assembly. For example, the translucent film may be procured in roll form and, therefore, is cut or slit into appropriate dimensions for assembly with the EL assembly. The EL assembly is preferably a layered construction that comprises (from top to bottom layers) a transparent substrate, a front transparent electrode layer, an EL layer, an insulating layer and a back electrode layer. To facilitate mass production-type assembly, the EL assembly and translucent film are formed as strips suitably sized to permit manufacture of a number of EL lamps at once.

At Block 110, the strip of translucent film is affixed to the EL assembly. In one embodiment, the translucent film may include, for example, a surface having adhesive applied thereto and then covered by a liner. Accordingly, at Block 110, the liner is removed to expose the adhesive and the translucent film is affixed to the EL assembly. As a result, an EL lamp comprising the layered construction illustrated in FIG. 1, is produced. It should be appreciated, however, that the present invention contemplates other methods of assembling the EL lamp 10.

Once the EL lamp is assembled, a desired surface configuration may be formed on a top surface of the translucent film. For example, at Block 120, the top surface of translucent film may be hot-stamped or brushed to produce surface configurations having finishes illustrated in FIGS. 3A–3C.

A preferred, yet non-essential, step in the exemplary manufacturing process is illustrated at Block 130. At Block 130 a selected number of EL lamp strips are affixed or joined to a roll of material to facilitate further processing thereof. For example, individual EL lamp strips may be affixed to a roll of adhesive tape. This process is also referred to as "webbing."

At Block 140, a blanking process separates the EL lamps from the roll. The EL lamps are then individually affixed to a dial-back to provide structural support to the EL lamp. At Block 150, a pattern of interest is applied or affixed to the top surface of the EL lamp and dial-back assembly. For example, time-indicating indicia and/or decorative graphics are printed or otherwise affixed to the top surface. The EL lamp manufacturing process is then completed with singulation, the process by which each completed assembly is "clipped" and "stocked" for individual usage, as the finished assembly may be incorporated within an-electronic device of interest.

Although described in the context of preferred embodiments, it should be realized that a number of modifications to these teachings may occur to one skilled in the art. As should be appreciated, the scope of the present invention is not limited to a particular usage within a type of electronic device. That is, while the present invention has been disclosed above with particular reference to timepieces, one skilled in the art shall now appreciate that the present invention is equally applicable, and as claimed herein, to devices other than timepieces, such as, but not limited to, clocks, stopwatches, thermometers (such as wall mounted thermometers), security devices and other portable electronic devices for use in the home or office in which it would be desirable to include a dial or display to be illuminated. Therefore, reference to an electronic device should equally be understood to refer to at least any of the aforementioned other devices. That is, the present invention methodology is applicable in any electronic device in which it would be desirable to provide EL lamps of dials or displays having metallic and/or textured surface configurations.

While the invention has been particularly shown and described with respect to preferred embodiments thereof, it will be understood by those skilled in the art that changes in form and details may be made therein without departing from the scope and spirit of the invention. For example, reference herein to forming the electroluminescent layer on the conductive layer should be understood to encompass the step of having the conductive layer formed on the electroluminescent layer. That is, the order of the forming steps recited in the claims should be read in a broad and not limited sense. Also, the order of forming steps may be varied while remaining within the scope of the invention. Lastly, the selection of the desired surface configuration is left to the designer.

What is claimed is:

1. An electroluminescent lamp for an electronic device, comprising:

a transparent substrate having a first and a second surface;

a translucent layer formed on the first surface of the transparent substrate, the translucent layer having a first surface in facing alignment with the first surface of the transparent substrate and a second surface that is textured;

a transparent electrically conductive layer formed on the second surface of the transparent substrate;

an electroluminescent layer formed on the transparent conductive layer;

an insulating layer formed on the electroluminescent layer; and an electrically conductive layer formed on the insulating layer;

wherein the translucent layer, the transparent substrate, the transparent electrically conductive layer, the electroluminescent layer, the insulating layer and the electrically conductive layer together comprise a layered assembly; and wherein light emanating from the electroluminescent layer passes through the translucent layer during an illuminated condition.

2. The electroluminescent lamp as set forth in claim 1, wherein the second surface of the translucent layer is comprised of a coarse textured finish.

3. The electroluminescent lamp as set forth in claim 1, wherein the second surface of the translucent layer is comprised of a smooth textured finish.

4. The electroluminescent lamp as set forth in claim 1, wherein the second surface of the translucent layer comprises decorative indicia affixed thereto.

5. The electroluminescent lamp as set forth in claim 1, wherein the second surface of the translucent layer comprises time-indicating indicia affixed thereto.

6. A method of manufacturing an electroluminescent lamp of an electronic device, the electroluminescent lamp comprising a layered assembly including a transparent substrate having a first surface and a second surface, an electroluminescent layer and a transparent electrically conductive layer interposing between the electroluminescent layer and the second surface of the transparent substrate, an insulating layer formed on the electroluminescent layer and an electrically conductive layer formed on the insulating layer, the method comprising steps of:

providing a translucent layer having a first surface and a second surface, wherein light emanating from the electroluminescent layer passes through the translucent layer during an illuminated condition;

affixing the second surface of the translucent layer to the first surface of the transparent substrate; and forming a textured finish on the first surface of the translucent layer.

7. The method as set forth in claim 6, including the step of forming a coarse textured finish on the first surface of the translucent layer.

8. The method as set forth in claim 6, including the step of forming a smooth textured finish on the first surface of the translucent layer.

9. The method as set forth in claim 6, including the step of forming a pattern of time-indicating indicia on the first surface of the translucent layer.

10. The method as set forth in claim 6, including the step of hot stamping the first surface of the translucent layer to form the textured finish.

11. The method as set forth in claim 10, including the step of applying a punch, heated to about 130° C., under about 90 PSI of pressure to the first surface of the translucent layer for about a 3 second ram down delay.

12. The method as set forth in claim 6, including the step of brushing the first surface of the translucent layer to form the textured finish.

13. The method as set forth in claim 12, including the step of applying a brush, turning at a spindle speed of about 1500 RPM, under about 90 PSI of pressure to the first surface of the translucent layer for about a 2 second ram down delay.

14. A method of manufacturing an electroluminescent lamp of an electronic device, the electroluminescent lamp comprising a layered assembly including a transparent substrate having a first and a second surface, an electroluminescent layer and a transparent electrically conductive layer interposing between the electroluminescent layer and the second surface of the transparent substrate, an insulating layer formed on the electroluminescent layer and an electrically conductive layer formed on the insulating layer, the method comprising steps of:

providing a translucent layer having a first surface and a second surface, the first surface having a surface configuration comprising a metallic finish, wherein light emanating from the electroluminescent layer passes through the translucent layer during an illuminated condition;

affixing the second surface of the translucent layer to the first surface of the transparent substrate; and forming a textured surface configuration on the first surface of the translucent layer.

15. A timepiece comprising:

a case;

an electroluminescent lamp, disposed within the case, comprising a transparent substrate having a first and a second surface; a translucent layer formed on the first surface of the transparent substrate, the translucent layer having a first surface in facing alignment with the first surface of the transparent substrate and a second surface that is textured; a transparent electrically conductive layer formed on the second surface of the transparent substrate; an electroluminescent layer formed on the transparent conductive layer; an insulating layer formed on the electroluminescent layer; and an electrically conductive layer formed on the insulating layer; and timekeeping functionality within the case;

wherein light emanating from the electroluminescent layer passes through the translucent layer during an illuminated condition.

* * * * *

UNITED STATES PATENT AND TRADEMARK OFFICE

CERTIFICATE OF CORRECTION

PATENT NO. : 6,515,416 B1
DATED : February 4, 2003
INVENTOR(S) : Arniel A. Chico It is certified that error appears in the above-identified patent and that said Letters Patent is hereby corrected as shown below:

Title page,
Item [73], should read: -- [73] Assignee: Timex Group B.V. (NL) --

Signed and Sealed this

Twenty-ninth Day of April, 2003

JAMES E. ROGAN
*Director of the United States Patent and Trademark Office*